United States Patent [19]

James

[11] Patent Number: 4,674,776

[45] Date of Patent: Jun. 23, 1987

[54] MORTISE LOCK HAVING SECURED STOPS

[75] Inventor: Paul James, Reading, Pa.

[73] Assignee: Baldwin Hardware Corporation, Reading, Pa.

[21] Appl. No.: 835,547

[22] Filed: Mar. 3, 1986

[51] Int. Cl.[4] ..... E05B 3/00; E05B 15/02

[52] U.S. Cl. ..... 292/40; 292/150

[58] Field of Search ..... 292/150, 245, 34, 36, 292/37, 40

[56] References Cited

U.S. PATENT DOCUMENTS

| | | | |
|---|---|---|---|
| 1,126,181 | 1/1915 | Clearer | 292/150 |
| 1,987,846 | 3/1935 | Arens et al. . | |
| 2,924,480 | 2/1960 | Holland | 292/336.3 |
| 3,211,486 | 10/1965 | Crandell | 292/348 |
| 3,361,464 | 1/1968 | Foster | 292/245 |
| 3,672,714 | 6/1972 | Schultz | 292/34 |
| 4,071,270 | 1/1978 | Alexander | 292/1 |
| 4,453,753 | 6/1984 | Fayerman et al. | 292/348 |
| 4,502,720 | 3/1985 | Fayerman et al. | 292/348 |
| 4,569,547 | 2/1986 | Fayerman et al. | 292/347 |

*Primary Examiner*—Henry E. Raduazo

*Attorney, Agent, or Firm*—Steele, Gould & Fried

[57] ABSTRACT

A mortise lock has two relatively-rotatable knob or lever-controlled spindles for independent operation from opposite sides of a door of a resiliently extending latchbolt and positively extending deadbolt, and stop buttons accessible at an edge of the door for blocking operation of the bolts from one side in a higher security state. The lock also has a safeguard effective to block a change in the state of the stop buttons to a lower-security state unless the deadbolt is first positioned at a pre-determined point between full retraction and full extension using a key. The lock is a double cylinder lock such that operation of the deadbolt from either side requires a key. The lock may be mastered such that operation of the deadbolt requires a master key while operation of the latch requires a common key. Therefore the ability to change the stop buttons is restricted.

17 Claims, 9 Drawing Figures

MORTISE LOCK HAVING SECURED STOPS

BACKGROUND OF THE INVENTION

1. Field of the Invention

This invention relates to the field of mortise locks having controllable stop means for altering operating characteristics of a handle on at least one side of the door, and in particular to a double cylinder mortise lock for commercial entrances, having means for restricted capability for changing the stop means.

2. Description of the Prior Art

Mortise locks are a well-known and popular means for affixing a closed, hinged door temporarily to its doorframe and thereby to prevent unauthorized passage through the door. A lock casing is mounted in a mortise cut into the edge of the door. A resiliently mounted latchbolt, which is biased to extend from the edge into the doorframe and may be retracted using a handle on a least one side (e.g., the indoor side) of the door, temporarily holds the door in the doorframe. The door is frequently spring-biased to close. The latchbolt has an inclined surface and bears against a strike plate such that upon closing the door the extending latchbolt is forced to retract by the edge of the strike plate, then as the door closes further the latchbolt extends into an opening in the strike plate on the doorframe.

For a more secure attachment of the door in the doorframe, a deadbolt is included in addition to the latchbolt, the deadbolt having a rectangular rather than sloping configuration and the deadbolt remaining fixed in either the extended or retracted position when so placed using a key or a control knob. The deadbolt is configured to resist retraction by use of tools forced between the door and the frame.

According to a popular style of mortise lock, the indoor-side handle and the outdoor-side handle are mounted on relatively-rotatable lengths of a spindle shaft, which are aligned axially. The handles are therefore independently rotatable, whereby one or both spindles are connected to press an eccentric projection against the spring-biased latchbolt to retract the latchbolt. Cooperating with a movable stop means, the dual-spindles are disposed at one of a range of more or less secure operating characteristics for the opposite sides of the door. For example, it may be advisable to assume a low-security operating characteristic in which a door is only temporarily latched and the knobs, levers or like handles on both the indoor and outdoor sides can be operated freely to withdraw the latchbolt. At slightly higher security but still with the deadbolt retracted, it may be advisable to prevent operation of the latchbolt at the outdoor-side handle, but to permit operation of the latchbolt from outdoors using a key. Such a change in operating characteristics is frequently accomplished using movable stop buttons.

The deadbolt is normally extended only when the door is closed. Even when a lock is in its highest security mode with the deadbolt extended, it is still advisable to permit escape from the building from inside, preferably without the need for a key. Accordingly, various means are known to disable lock functions in emergencies.

Many mortise locks have stop buttons that determine whether the handle on one side (e.g., outdoors) can withdraw the latchbolt or whether a key is needed. The usual form for movable stop buttons for setting the lock to a desired security state is a pair of buttons mounted at an edge of the door that is covered by the doorframe when the door is closed. The stop buttons are pivotally connected to flip-flop such that when one is advanced the other is automatically retracted, and vice-versa. One of the two stop buttons can then be attached to a stop abutment movable into rigid engagement to block rotation of a latchbolt-retracting part, such as the hub to which one of the handle spindles is mounted, preventing rotation of the spindle and attached handle when the stop is set. Therefore, when the stop is set and the abutment is moved to engage the hub on one side of the door, the handle on that side cannot be used to retract the latchbolt.

When a handle on one side is disabled using the stop, the door can normally still be opened on that side using a key. Mortise locks of this type may be provided with lock cylinders on one or both sides that by one means or another allow different operations to be accomplished only using different keys. Multiple levels of mastering are possible, with keys at higher levels capable of more of the operations. For example a so-called "hotel cylinder" is equipped to allow the holder of a master key to operate both the deadbolt and latchbolt, while the holder of a maid's key can operate the latchbolt only. Therefore, in the event the deadbolt is set, the maid's key will be ineffective to gain access. Hotel cylinder mechanisms according to such a description may operate by restricting the angular displacement that one key or another will cause in the lock cylinder. There are also known hotel cylinder mechanisms in which the low-level security keys will turn the cylinder in only one direction, and the high-level master keys will turn the cylinder in either direction. In the latter type of lock, turning the cylinder in one direction can be made to operate the latchbolt and turning the cylinder in the other direction can operate the deadbolt.

A mortise lock of the type that if used with a hotel cylinder is adapted to operate the latchbolt by turning the key cylinder in one direction and to operate the deadbolt by turning the key cylinder in the opposite direction is shown in U.S. Pat. No. 4,453,753—Fayerman et al (see FIG. 9 thereof), the disclosure of which is hereby incorporated. The patent also shows a lock with movable stop buttons adapted to block rotation of one of the handles when the stop is set. In that device, as a means of improving the security of the lock when the deadbolt is extended, a linkage is provided between the deadbolt and a stop button such that extension of the deadbolt automatically moves the stop button having the hub-blocking abutment into engagement with the spindle hub. In this manner, whenever the deadbolt is extended, the spindle on the relatively more restricted-access side of the door (e.g., outside) is blocked against rotation. This more positively locks the door. The stop remains set until manually released.

According to the conventional mortise lock, anyone on the indoor side and anyone with a key on the outdoor side can always open the door in the normal way, change the state of the edge-mounted stop buttons, and thereby disable the outside locking function by retracting the stops. When door is closed and locked, an intruder can sometimes insert a tool between the door and doorframe of known locks and operate the stop buttons to gain entry via the outdoor-side handle, even without bothering the latchbolt and/or deadbolt directly. An accomplice or the intruder himself can surreptitiously retract the stop buttons when the door is opened for some innocent purpose, the intruder thereafter returning to gain access because the released stops make the latchbolt retractable via the handle.

According to the prior art, the foregoing security drawbacks must be borne if the user requires the ability to change between functioning characteristics of the lock by means of stops. According to the invention, however, the stop buttons are still as useful and versatile for their security attributes as ever to persons holding a key, or possibly a master key. Nevertheless, even when the door is opened and the stop buttons exposed, the stops are blocked against any change in security characteristics by persons having no key or low security keys or persons who may by hook or by crook gain access to the edge of the door at which the stop buttons are located. The blockage of the stop buttons in the invention is physically linked with the deadbolt, which can preferably be extended only using a key or master key. A detent position of the deadbolt between full extension and full retraction of the deadbolt is provided at which the stop buttons can be re-positioned when the deadbolt is extended or retracted using a key. The stop buttons cannot be re-positioned when the deadbolt is fully either extended or retracted. The deadbolt is biased towards full extension and/or full retraction. Retraction of the deadbolt using the indoor-side handle (e.g., during emergency escape) bypasses the detent position. Placing the deadbolt at the detent requires a key; therefore, the position of the stop buttons is secure.

SUMMARY OF THE INVENTION

It is an object of the invention to maximize security in a mortise lock at minimum additional inconvenience and expense, and without adversely affecting safety.

It is another object of the invention to derive full advantage from the use of multiple levels of lock security characteristic such as set using stop buttons and master keys, by applying key functions to control operating areas of the lock not directly associated with the lock cylinder, such as the stops.

It is another object of the invention to provide a mortise lock which is particularly adapted for use on commercial entrances.

It is still another object of the invention to reserve the ability to change security characteristics of a lock to a limited group of persons responsible for security, and to prevent unauthorized change in an operating mode even by persons having access to the edge of the door.

It is a further object to achieve the foregoing objects in a lock that is externally indistinguishable, and for the most part operationally indistinguishable, from conventional mortise locks.

These and other objects are accomplished by a mortise lock of the type having relatively-rotatable spindles for independent operation at opposite sides of the door to retract a latchbolt and/or deadbolt and movable stop buttons accessible at an edge of the door for blocking rotation of one of the spindles. The lock is provided with a safeguard effective to block any change in the stop buttons to a lower-security state unless the deadbolt is first positioned at a pre-determined point between full retraction and full extension. The deadbolt may be biased to assume one or the other of a fully retracted and fully extended position. Operation of the deadbolt requires a master key, and therefore changing the stop buttons to allow access can be accomplished only using a master key, even though retraction of the deadbolt can be accomplished using either a key or, for safety reasons, using the indoor-side handle.

BRIEF DESCRIPTION OF THE DRAWINGS

There are shown in the drawings the embodiments which are presently preferred. Features of the invention are subject to embodiment in various groupings even though they may appear separately for purposes of illustration. It should be understood that the invention is not limited to the precise arrangements and specific instrumentalities shown in the drawings, wherein.

DETAILED DESCRIPTION OF THE PREFERRED EMBODIMENTS

Figure 1:
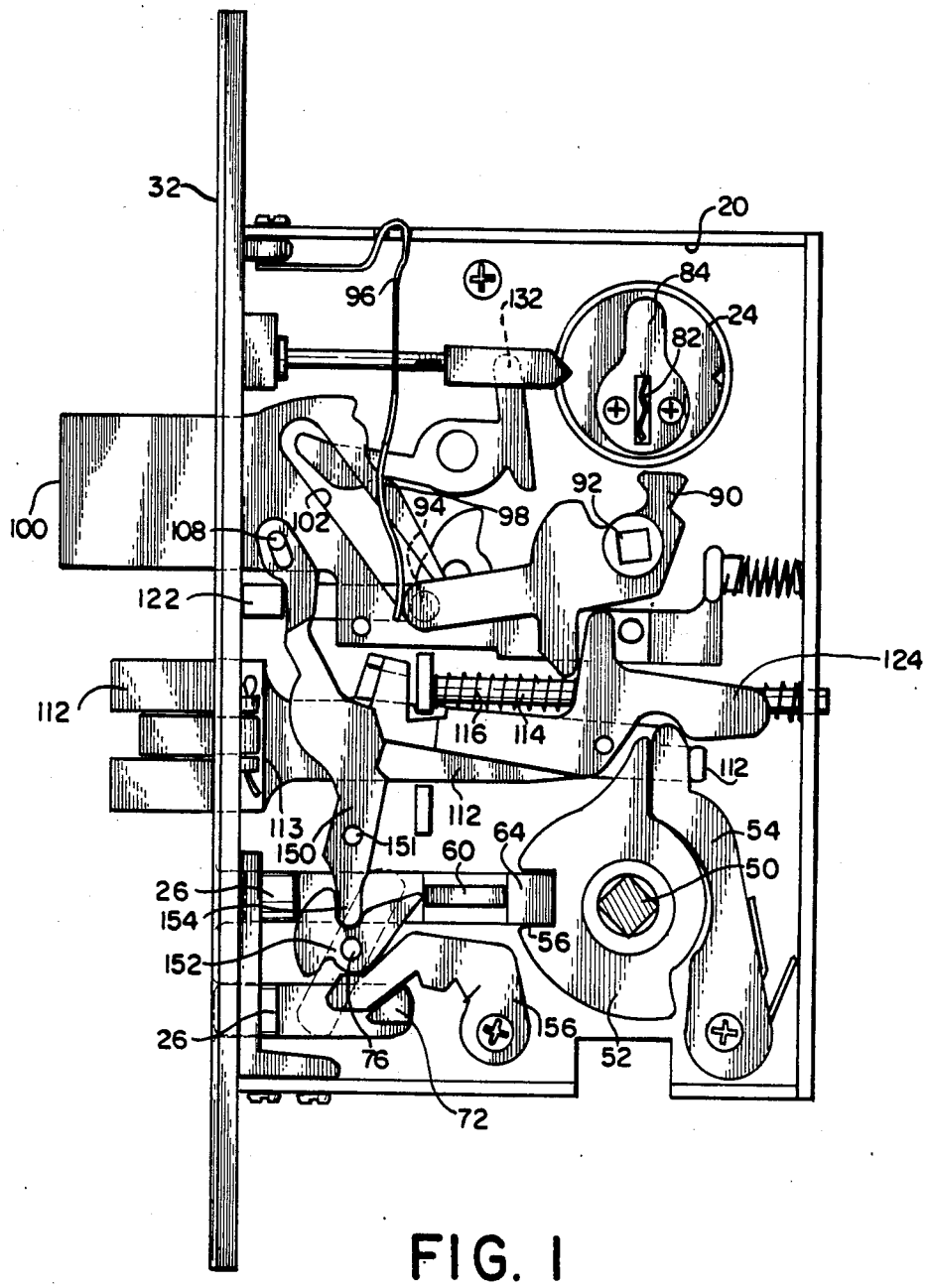
FIG. 1 is a partially broken-away view showing internal workings of a mortise lock according to the invention, the low security side (e.g., indoor-side) cover shown broken away.
Figure 2:
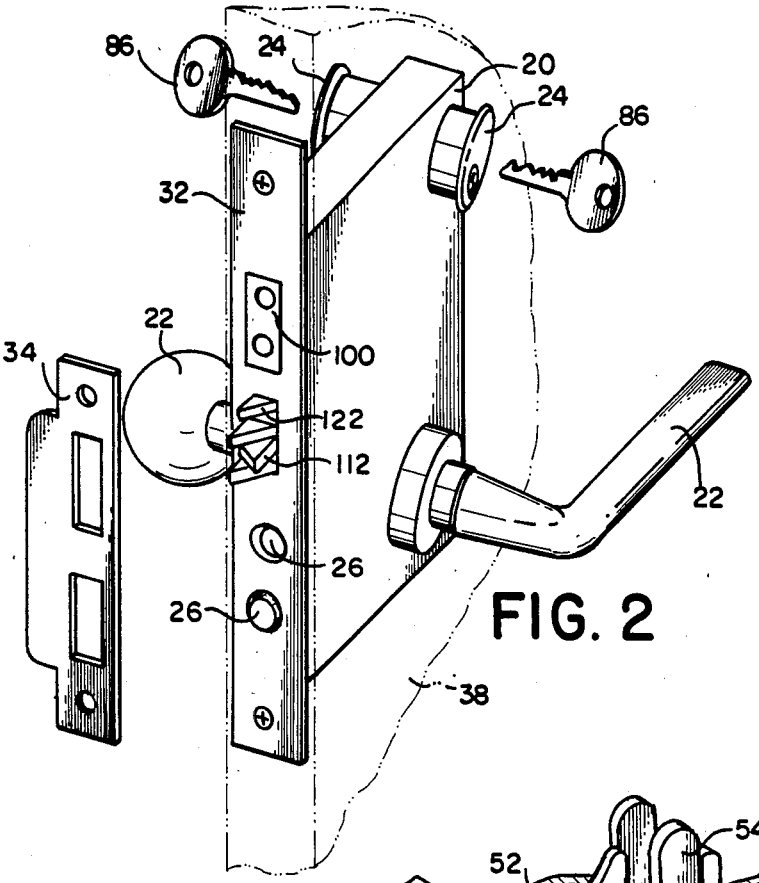
FIG. 2 is a perspective illustration of the mortise lock installed in the door, spaced from the strike plate on the doorframe.

The lock of the invention is illustrated with the cover partly removed in FIG. 1, and is shown in its installed state in FIG. 2. The directly-manually-operable elements of the device include handles 22 and lock cylinders 24, provided on both opposite faces of the door 38, and stop buttons 26, which are accessible at the edge of the door. The stop buttons 26 are protected by the frame when the door is closed, except from thin tools placed between the door and frame. In addition to the directly-manually-operable elements, the deadbolt 100, latchbolt 112 and auxiliary bolt 122 are movable elements which cooperate with a strike plate 34, mounted on the door frame or jamb which the door is intended to block when closed.

Latchbolt 112 has an inclined extending end portion and is resiliently biased to extend from end face 32 of lock casing 20. As the door is closed, the inclined end of latchbolt 112 encounters strike plate 34 and is forced to retract into the casing 20, until as the door closes further it is aligned in the doorframe, i.e., completely closed. Upon full closure, latchbolt 112 again extends, engaging an opening provided in strike plate 34. A similar opening is provided in strike 34 to engage deadbolt 100 which is controllably retractable and extendable in a positive manner using key 86. The deadbolt has a flat rather than inclined contour. Deadbolt 100 is biased by spring 96 to be stable at full extension and at full retraction.

Auxiliary bolt 122 has an inclined end portion as does latchbolt 112, however, auxiliary bolt 122 has no corresponding hole in strike plate 34. Therefore, when the door is closed, auxiliary bolt 122 remains retracted by contact with the strike plate.

The lock is adapted for presenting different security aspects at a higher security side (e.g., an outdoor side) and a lower security side (e.g., an indoor side). The difference between such sides is the extent to which the user is free to retract deadbolt 100 and latchbolt 112 using handle 22.

In its most-battened-down condition as shown in FIG. 1, both latchbolt 112 and deadbolt 100 extend from the lock casing into the doorframe. Auxiliary bolt 122 is retracted, causing dog lever 124 to rest on hub lever 54 and hub 52, in turn dead latching latch bolt. On the low security side of door (inside), when knob (22) is turned and when when deadbolt (100) is fully extended, dead bolt (100) and latch bolt (112) will be retracted simultaneously in a single turn of knob (22) either direction. The stop buttons 26 are set such that end 64 of one of stop buttons 26 extends into opening 56 of handle hub 52, preventing rotation of split spindles 50 from one side of the door. Latchbolt 112 is extended whereupon the door is held closed or retracted such that the door is allowed to open by means of retraction of latchbolt 112 against the bias of spring 116. According to a preferred embodiment, latchbolt 112 may be withdrawn either by means of key operation of cylinder 24 causing cylinder tab 84 to bear against cylinder lever 132, or by rotating a handle mounted on spindle 50. The handle may be a knob or lever or other suitable operator affixed to spindle 50. Turning the handle urges hub 52 to rotate, thereby retracting latchbolt 112.

Figure 8:
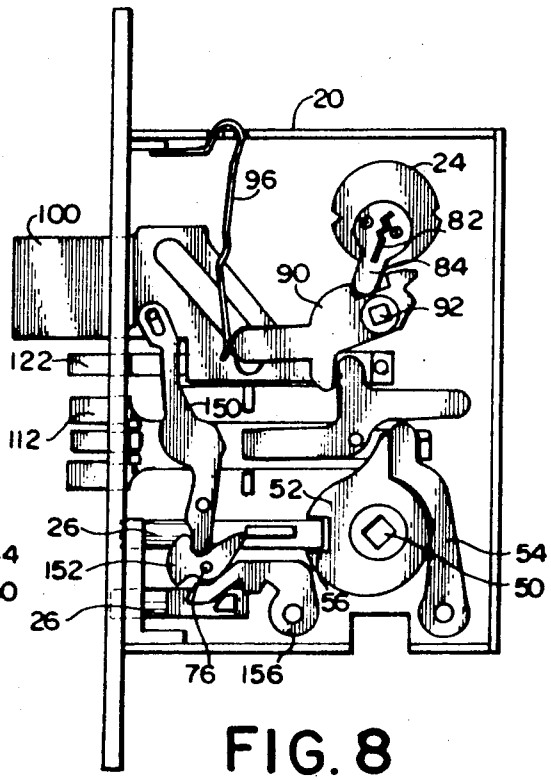

Latchbolt 112 is slidably mounted along rod 114, and resiliently biased to remain in an extended position by means of helical spring 116, on rod 114. FIG. 1 shows an embodiment for use with a knob, i.e., operable when spindle 50 is rotated in either direction. In retracting the latchbolt, rotation of spindle 50 causes one or the other of the radial extensions of spindle hub 52 to press against hub lever 54, toward the right in FIG. 1. Lever 54 engages the end of latchbolt 112 and retracts latchbolt 112 against the pressure of spring 116. The user can also retract latchbolt 112 using a key rotated counterclockwise as shown in FIG. 8. A separate linkage including latch lever 132, operated from the lock cylinder 24, and a linkage 134 of pivotally mounted connecting elements, allows the latchbolt to be withdrawn independently of rotation of spindle 50.

Figure 3:
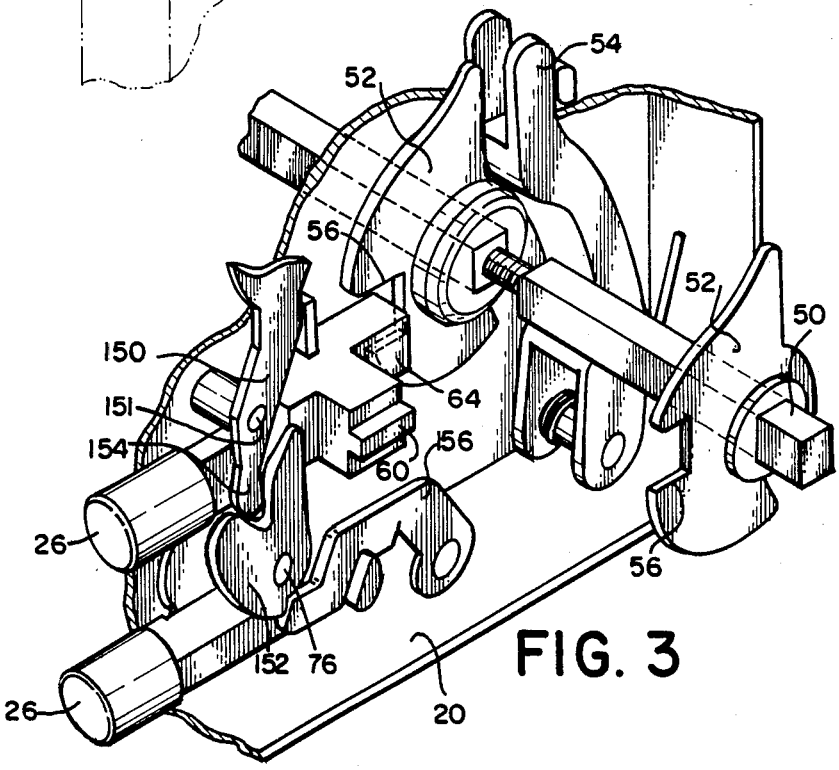
FIG. 3 is a partial perspective view illustrating the interaction of the spindle hubs, stop buttons and safeguard means according to the invention.

Spindle 50 is preferably a two-part rod having a non-round cross section, e.g., square. The indoor and outdoor side parts of spindle 50 are relatively rotatable by means of their coaxial threadable interconnection, as shown in FIG. 3. The spindle parts are threadably connected only loosely, such that each is independently rotatable. A separate spindle hub 52 is provided for each of the indoor and outdoor sides, and stops 26 are cut such that the hub 52 only on one side (e.g., the outdoor side) is blocked by setting the stops. In this manner, the spindle portions protruding from each side of the door, and the handles mounted thereupon, are provided different capabilities. On the low-security side, usually the indoor side, rotation of the spindle is always effective to withdraw the latchbolt and deadbolt when extended. On the high security side, usually the outdoor side, the lock may be disposed in at least two different modes even while the deadbolt is retracted. In a low security mode achieved by retracting the stop abutment 64 from spindle hubs 52, rotation of the high security side (e.g., outdoor) spindle will withdraw the latchbolt in the same manner as occurs on the low security (e.g., indoor) side. However, by moving stop buttons 26 to the position shown in FIG. 1, rotation of one of spindle hubs 52 can be blocked, allowing only the other spindle to withdraw the latchbolt normally.

Only the upper stop 60 is actually used directly to block rotation of the spindle hub 52. The lower one of the stop buttons is connected to the upper stop button 60 by means of a linkage 74, pivotally connecting stops 26 to stationary post 76 such that when either of the stop buttons 26 is depressed, the other is automatically retracted, and vice-versa. The stop buttons may be guided in casing 20 by tabs 72, which slide along slots in the casing.

According to the invention, the normally free operation of the stop buttons 26 at the edge of the door is modified such that when the deadbolt has been either fully retracted or fully-extended, any attempt to retract the stop 60 blocking hub 52 is prevented. Linkage 150 pivots on pin 151 and has an extending lever arm 154 that bears against stop cam 152 mounted on post 76. Cam 152 bears either on stop 60 or stop button-retaining lever 156.

FIG. 3 illustrates the interaction of stop 60 and spindle hub 52. The protruding end 64 of upper stop 60 extends into a complementary onening 56 in the secure (e.g., outdoor) side spindle hub 52 provided for the attached, but relatively-rotatable shafts 50,50. The abutment 64 at the end of stop 60 is preferably less than half the depth of lock casing 20 such that only one of the spindle hubs 52, e.g., the outdoor side hub, can be blocked by abutment 64 when advanced against hubs 52. The other of the hubs, e.g., the indoor side hub, remains free of upper stop 60, and therefore that side of the spindle shaft remains movable, even when stop 60 is in its operative blocking position.

A person on the outdoor or like high-security side can of course gain access to the premises if a person on the indoor or low-security side operates the spindle on that side and opens the door. According to the invention, an accomplice or like person lacking a key on the low-security side cannot readily open the door in order to change the position of the stops 26 to permit future access of a person on the high-security side when no one is around.

Linkage 150 is loosely attached to deadbolt 100 at pin 108. The linkge 150 and extension 154 carried thereon are moved during operation of the deadbolt. With the deadbolt fully retracted, extension 154 urges cam 152 counterclockwise, holding lever 156 down on the lower stop button. Upon full extension of deadbolt 100, extension 154 urges cam 152 clockwise, holding upper stop 60 in its blocking position shown in FIG. 1. When the deadbolt is either extended or retracted, any change in position of the stops, in either direction, is impossible. In this manner, incidental contact with the stop cannot inadvertently lock anyone out; and, even when the door is locked and/or deadbolted, an intruder cannot insert a tool between the facing door edge 32 and the doorframe to gain access by changing the position of the stops for future entry.

For reasons of safety, operating the indoor side spindle 50 automatically retracts the deadbolt as it retracts the latchbolt. An inward facing edge 113 of latchbolt 112 contacts linkage 150 as latchbolt 112 retracts. The operation of linkage 150 causes the stops 26 to be set. Therefore, an indoor side occupant can escape safely in the event of fire even if the deadbolt is set. Regardless of such escape, the stops are positively set.

The lock preferably has key-operable lock cylinders 24 for both sides of the door, i.e., a double-cylinder arrangement. Cylinder 24 is preferably of the type having means to prevent full rotation, or to prevent rotation in either direction, for certain of the keys of a larger set of keys. For example, master keys are provided for use by security personnel, emergency personnel and the like which can be used to turn cylinder 24 in either direction and thereby move either the deadbolt or the latchbolt. The deadbolt is extended by rotating a key in keyhole 82, thereby rotating tab 84, which is rigidly attached to the key-carrying cylinder, in a clockwise direction in FIG. 1. Tab 84, when rotated contacts turnhub lever 90, which rotates around pivot 92. A pin, located at the end 94 of turnhub lever 90 slides in inclined slot 102 in deadbolt 100. Therefore, when cylinder tab 84 is rotated clockwise using a key, cylinder lever 90 rotates counterclockwise around pivot 102, and deadbolt 100 is forced to extend from casing 20, thereby locking the door in the doorframe.

Biasing spring 96 has an intermediate bend 98 at which end 94 can rest, and otherwise is disposed to urge end 94 of cylinder lever 90 to either its uppermost position, at which the deadbolt is retracted, or its lowermost position at the lower end of spring 96, at which the deadbolt is extended. All three positions hold cylinder lever 90, but the intermediate position can only be reached with a key. At the intermediate position of lever 90, linkage 150, which is pivotally connected to deadbolt 100 at pin 108, hold cam 152 between the positions at which is holds the stops 26 in place. Therefore, only when the deadbolt is partially retracted can the stop buttons be changed. The deadbolt can be partially retracted when the stops are in either of their positions, but the full extension of deadbolt 100 will set the stops. Accordingly, to release the stops the user of a key must change the stops at the intermediate detent 98 of spring 96, then retract the bolt 100. Extending the bolt will again set the stops.

The relative positions of the various parts of the mortise lock of the invention are shown in FIGS. 4–9 in different stages of operation. In reviewing the Figs., it will be appreciated that the stops may be set and held either by virtue of cam 152 bearing directly on the upper stop 60, or by pivotal cam 152 holding lever 156 against the lower stop button. Inasmuch as the upper and lower stop buttons 26, 26 are pivotally connected in a flip-flop manner, both of these positions retain the stops.

Figure 4:
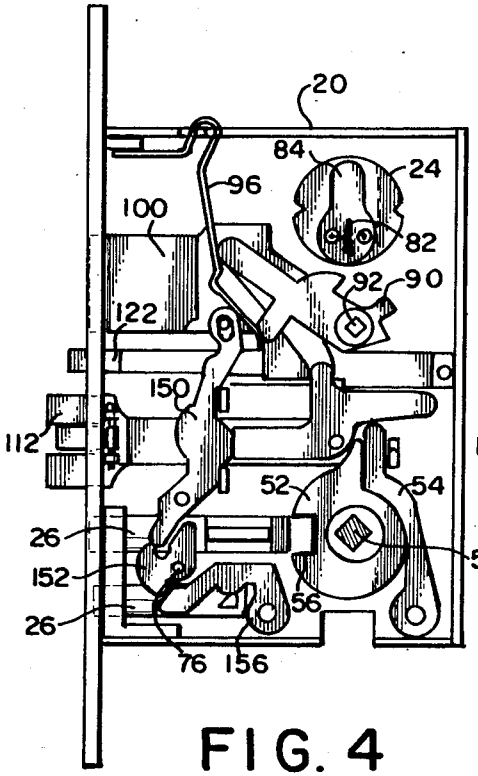

As noted above, FIG. 1 shows the lock in its most-battened-down condition, with the deadbolt extended and the stops set. FIG. 4 shows the lock in its least-battened condition. The deadbolt is retracted and the stops are released (i.e., upper stop 60 is retracted from spindle hub 52). In this condition, either the indoor side handle or outdoor side handle will cause the latchbolt 122 to retract. Retracting the latchbolt will simply release the door from the frame, and will have no effect on the current position of the stops. This is so because linkage 150 is spaced inward from rear-facing edge 113 of latchbolt 112 due to deadbolt 100 being retracted.

Figure 5:
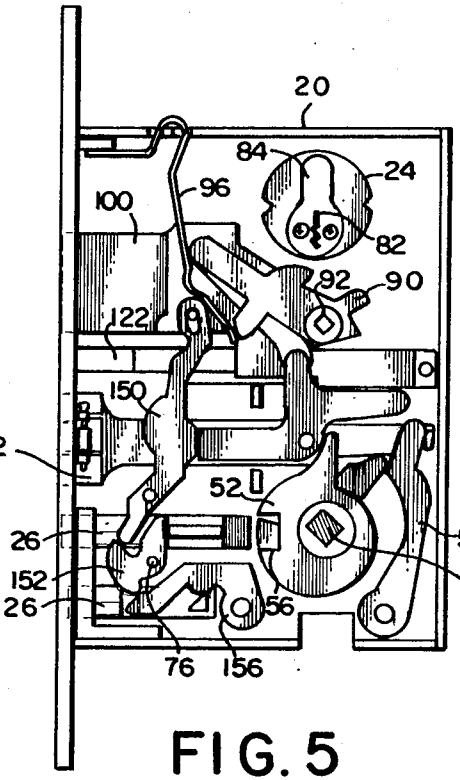

In the Figs., the lock is viewed from the lower-security side, normally the indoor side. In FIG. 5, the door as viewed for the indoor side is being opened by means of a handle on the outdoor side. The lowermost hub 52 on the outdoor side is being rotated by means of a spindle and handle, causing hub lever 54 to rotate rightwards, carrying latchbolt 112 and auxiliary bolt 122 backwards such that the door is released from its frame. In FIGS. 4 and 5, the position of cam 152 is such that stop lever 156 is held down on the lower one of stop buttons 26. Lever 156 has a pair of notches that engage the lower stop button in either of its two positions. Lever 156 is spring biased toward cam 152, but as shown in FIGS. 4 and 5, lever 156 holds the stops in their current position in which extension 154 of linkage 150 positions the cam clear of stop 60 and engaged against stop lever 156.

Figure 6:
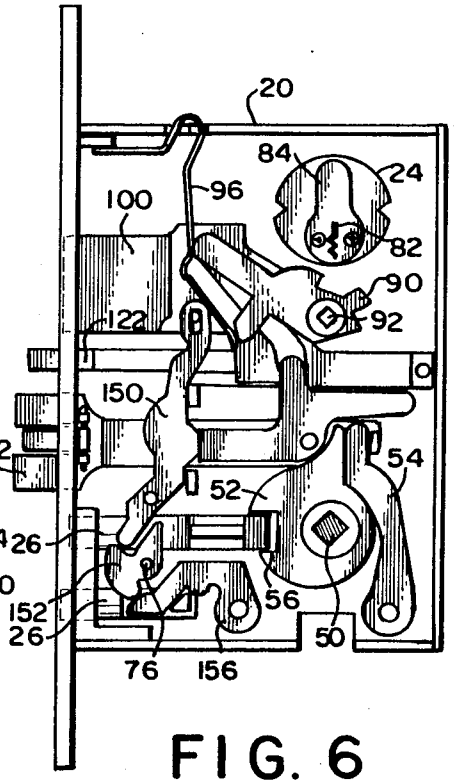
FIGS. 4–9 are elevation views of the lock of the invention from the indoor or lower security side, with cover removed, showing various security conditions of the stops and stages of extension of the latchbolt and deadbolt, as discussed hereinafter.

FIG. 6 shows the lock with the stops set in their secured position, i.e., with upper stop 60 advanced such that the end 64 of stop 60 is located against hub 52 and prevents rotation of outdoor-side hub 52 by means of its spindle. The indoor-side hub 52, i.e., the one visible in FIG. 6, can still be rotated in the manner as before. However, the outdoor side hub 52 is now blocked. Inasmuch as the deadbolt 100 is retracted, cam 152 is in the same positions as in FIGS. 4 and 5, i.e., holding stop lever 156 down on the lowermost stop 26, an end of which rests in a notch on lever 156. In this case, however, the lowermost stop is in the retracted position and upper stop 60 is in the advanced position toward the right. Stop 60 accordingly blocks any user on the outdoor side from operating the knob, lever or other handle that would withdraw latchbolt 112.

Figure 7:
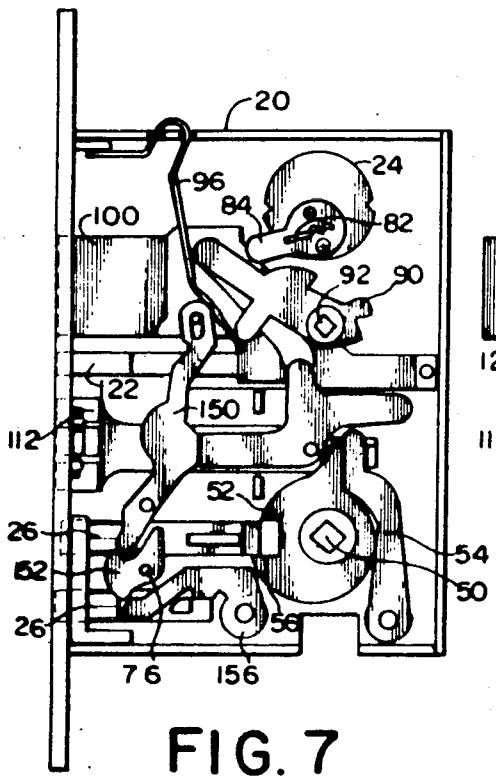

The outdoor user can retract latchbolt 112 using a key, as shown in FIG. 7. Cylinder 24 may be of a type that is "mastered," i.e., having certain keys which allow operation in only one direction. The key in FIG. 7 need not be a master key, but can be a normal key that will allow the user to retract the latchbolt by rotating cylinder tab 84 against tab 132. Tab 132, by means of a further linkage member, bears directly against latchbolt 112 and does not require that the spindle hub 52 be rotated in order to withdraw latchbolt 112. The outdoor-side key user can therefore open the door and expose stop buttons 26. The user of this non-master key can gain access but cannot change the current position of the stops because cam 152 remains in position, holding the stop lever 156 against the lower stop 26, and thereby preventing any change in either stop. When the deadbolt is extended, tab 132 is rotated out of range of cylinder tab 84 (see FIG. 1).

Should the user hold a master key, the deadbolt can be advanced or retracted. FIG. 8 shows the deadbolt at its fully-advanced position, which is reached by rotating tab 84 of cylinder 24 in a clockwise direction as illustrated. Tab 84 engages turnhub lever 90, causing the turnhub lever to rotate counterclockwise, whereupon pin 94 at the end of the turnhub lever forces deadbolt 100 outwards along inclined slot 102. In FIG. 8, the uppermost stop 60 is held by the stop cam 152 rather than by stop lever 156, which is now lifted above the lowermost stop button by spring bias, the back edge of cam 152 being moved out of the way. The stops are held in position and cannot be altered even by a tool or other implement which might be forced between the mortise lock and the door jam.

Figure 9:
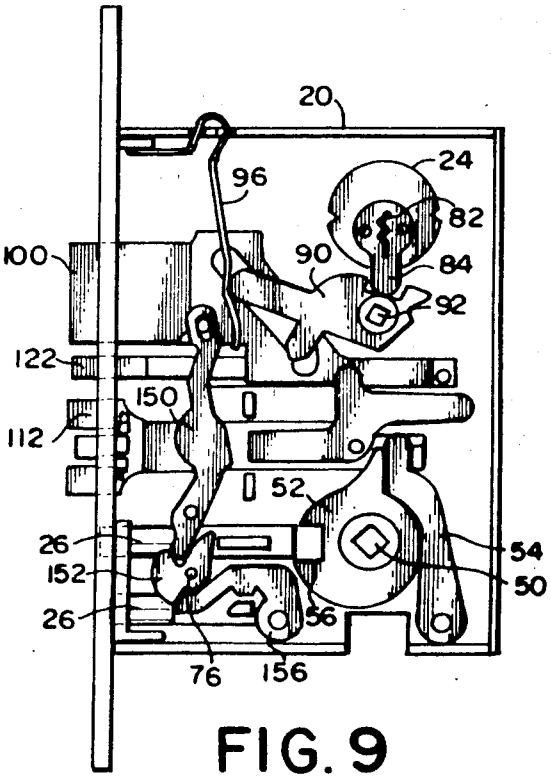

The only condition in which the stops can be set or re-set is shown in FIG. 9. Turnhub lever 90 is positioned at an intermediate spot along inclined slot 102 such that deadbolt 100 is about halfway extended. Deadbolt 100 is stable at this position by means of a shallow detent bend 98 in spring 96. At this position, stop lever 156 is raised above the lowermost stop *and* cam 152 does not bear against the uppermost stop 60. Cam 152 is centrally oriented between its extremes of movement. Therefore, the stops can be retracted as shown in FIG. 9 or advanced to change from the lower security situation (e.g., FIG. 4) and the higher security mode (FIG. 6).

The user of the indoor-side handle can retract the latchbolt, and can also retract deadbolt if set, using only the handle and its associated spindle 50. This is done by rotating the indoor-side unobstructed hub 52 against hub lever 54 and thus against the raised end of latchbolt 112. This causes edge 113 at the backside of the inclined head of latchbolt 112 to press against linkage 150, which is connected to the deadbolt. Linkage 150 then urges deadbolt 100 to retract. The outdoor-side spindle cannot be so operated due to the blockage against rotation of the outdoor-side hub 52 caused by abutment 64 of upper stop 60. If the stops are not set, both handles can freely withdraw the latchbolt.

The indoor-side handle operator cannot reset the stops by positioning the deadbolt at its half-extended position. The deadbolt can be retracted but cannot be advanced using the lever handle, and as the deadbolt is retracted, it will be resiliently urged to jump to its fully-retracted position past the shallow detent bend in spring 96. Moreover, if the user attempts to stop halfway, the deadbolt will remain in the doorframe and the user cannot gain access to the stop buttons anyway.

The lock of the invention is especially useful for double-cylinder lock commercial entrances. The latchbolt is operable by a knob handle (FIGS. 1 and 3) or lever handle (FIGS. 4–9) or other handle from either side, except when the ouside handle is locked by stop 60. When the outside handle is locked, the latchbolt and deadbolt can be retracted by key from outside (preferably the deadbolt requires a master key), and by handle from inside. The deadbolt can be extended by key from either side. Extending the deadbolt automatically causes the outside handle to be locked because linkage 150 presses stop 60 toward hub 52 when the deadbolt is extended. The inside knob retracts the latch and deadbolt simultaneously, but does not free the outside knob. Extension of the deadbolt also deadlocks the latchbolt. The auxiliary latchbolt further deadlocks the latchbolt.

The lock function is especially useful for exterior doors on commercial entrances becaues the stops cannot be activated unless a key is used to engage or disengage the stop mechanisms. This prohibits any unauthorized individual from locking or unlocking the door. When the deadbolt is thrown both the deadbolt and auxiliary latchbolt guard the latchbolt from being retracted. Security guards can therefore strictly control access to and from the building, especially using master keys for the specific requirements.

The invention having been disclosed, a number of additional variations will now become apparent to persons skilled in the art. Reference should be made to the appended claims rather than the foregoing specifications as indicating the true scope of the invention.

What is claimed is:

1. A mortise lock of the type having relatively rotatable spindles permitting independent operation of the spindles from opposite sides of a door using handles connected to the spindle, and a deadbolt extendible for engaging a doorframe and retractable into the lock, the lock having a stop means accessible from an edge of the door, the stop means being movable between at least two states, in one of which states the stop means blocks operation of the spindle on one of said opposite sides, the lock comprising:

safeguard means connected to the deadbolt and positioned by the deadbolt to prevent movement of the stop means between said two states when the deadbolt is fully extended and when the deadbolt is fully retracted, said safeguard means permitting movement of the stop means when the deadbolt is partially retracted, whereby the state of the stop means can be changed only during operation of the deadbolt.

2. The lock of claim 1, further comprising at least one spring urging the deadbolt toward stable positions at full extension and full retraction of the deadbolt.

3. The lock of claim 2, wherein said at least one spring includes a detent intermediate full extension and full retraction of the deadbolt, at which detent the deadbolt can be reset for changing the state of the stop means.

4. The lock of claim 1, where the deadbolt is extendable only by means of a key, whereby the key is needed for changing the state of the stop means.

5. The lock of claim 4, further comprising means for retracting the deadbolt using a handle on one of said opposite sides.

6. The lock of claim 1, further comprising a spindle hub for each of said opposite sides, and a latchbolt resiliently biased to extend from said edge, rotation of the spindle hub causing retraction of the latchbolt, the stop means having a slidable pin with an abutment engaging the spindle hub for one of the opposite sides in a blocking state and slidable clear of the spindle hub in a free state.

7. The lock of claim 6, comprising two stop buttons connected in a flip-flop manner and wherein the safeguard means includes a linkage pivotally connected to the deadbolt and to a casing of the lock, the linkage having an end opposite the deadbolt that bears against one of the stop means when the deadbolt is fully advanced and bears against the other of the stop means when the deadbolt is fully retracted, whereby the stops can be changed only during partial retraction of the deadbolt.

8. The lock of claim 1, wherein the lock is a double cylinder lock having key-operable lock cylinders on both opposite sides thereof, the cylinders being connected to withdraw the deadbolt if turned in a first direction and to withdraw the latchbolt, independent of the spindle and independent of the stop means, if turned in a second direction.

9. The lock of claim 8, wherein said at least one of the lock cylinders is a multiple-key master cylinder for use with a plurality of different keys, a limited number of which keys are operable to turn the cylinder in said second direction.

10. A lock to be mounted at a free edge of a hinged door for affixing the door to the doorframe, the lock having means for receiving at least one handle and a key-operable lock cylinder accessible at a face of the door, a latchbolt and a deadbolt extendible from an edge of the door to engage the doorframe, and at least one manually-movable control stop accessible at the edge of the door for controllably enabling an operating characteristic of the door, the lock comprising:

a deadbolt linkage connecting said lock cylinder and said deadbolt, the deadbolt being retractable by operating the lock cylinder using a key;

a latchbolt linkage connecting said means for receiving at least one handle to said latchbolt, the latchbolt linkage being engaged by said control stop when said operating characteristic is set; and, a connecting linkage between the deadbolt and the control stop, the connecting linkage blocking movement of the control stop when the deadbolt is fully extended and when the deadbolt is fully retracted, the connecting linkage having an intermediate position free of the control stop when the deadbolt is partly retracted, whereby said operating characteristic can be enabled and disabled only by operation of the deadbolt.

11. The lock of claim 10, wherein the operating characteristic is a capability to retract the latchbolt using the handle.

12. The lock of claim 11, further comprising a two-part spindle, each part having means for receiving a handle on one of two opposite sides of the door, and the parts of the spindle being relatively-rotatable, the operating characteristic being a capability to retract the latchbolt on one of the opposite sides using the handle on said side.

13. The lock of claim 10, wherein the lock cylinder is operable by means of a least two different keys, said different keys enabling different functions of the lock cylinder.

14. The lock of claim 10, further comprising a second lock cylinder accessible at an opposite face of the door.

15. A mortise lock comprising:

a casing with key cylinders on opposite sides;

a deadbolt in the casing, the deadbolt being extendable from an edge of the casing and spring biased to fully extend and fully retract, the deadbolt adapted to engage a doorframe when extended;

a latchbolt in the casing, the latchbolt being spring biased to fully extend through the edge to engage the doorframe;

a split spindle extending through the casing and having relatively rotatable opposite ends for carrying handles;

a spindle hub for each of the two ends of the spindle, the spindle hubs having eccentric means for engaging and retracting the latchbolt, one of the spindle hubs having a stop cooperating with an eccentric means on the spindle hub for receiving the stop, the stop being movably mounted at the edge of the casing;

a linkage attached to the deadbolt and positioned by the deadbolt to block movement of the stop when the deadbolt is retracted and when the deadbolt is extended, the linkage allowing movement of the stop when the deadbolt is positioned intermediate extension and retraction.

16. The lock of claim 15, wherein the stop has two buttons connected to flip-flop and the linkage is urged against a surface of one of the buttons during extension of the deadbolt and against a surface of the other of the buttons during retraction.

17. The lock of claim 16, wherein the linkage has a movable cam and a locking lever, the cam bearing on one of the stop buttons in a first direction and bearing on the locking lever in an opposite direction, the locking lever bearing on said other of the stop buttons.

* * * * *